US007129031B2

(12) United States Patent
Loccufier et al.

(10) Patent No.: US 7,129,031 B2
(45) **Date of Patent: *Oct. 31, 2006**

(54) RADIOGRAPHIC SILVER HALIDE PHOTOGRAPHIC MATERIAL HAVING A GOOD DEVELOPING SPEED, AN EXCELLENT IMAGE TONE AND LOW RESIDUAL COLOR AFTER PROCESSING

(75) Inventors: Johan Loccufier, Zwijnaarde (BE); Dirk Bollen, Sint-Truiden (BE)

(73) Assignee: Agfa-Gevaert, Mortsel (BE)

( * ) Notice: Subject to any disclaimer, the term of this patent is extended or adjusted under 35 U.S.C. 154(b) by 109 days.

This patent is subject to a terminal disclaimer.

(21) Appl. No.: 10/872,182

(22) Filed: Jun. 18, 2004

(65) Prior Publication Data

US 2005/0191589 A1 Sep. 1, 2005

(30) Foreign Application Priority Data

Jun. 19, 2003 (EP) ..... 03101808

(51) Int. Cl.

| | |
|---|---|
| ***G03C 1/46*** | (2006.01) |
| ***G03C 1/08*** | (2006.01) |
| ***G03C 1/06*** | (2006.01) |
| ***G03C 1/005*** | (2006.01) |
| ***G03C 1/494*** | (2006.01) |

(52) U.S. Cl. ..... 430/502; 430/503; 430/508; 430/567; 430/598; 430/599; 430/600; 430/603; 430/607; 430/611; 430/613; 430/570

(58) Field of Classification Search ..... 430/502, 430/503, 508, 567, 598–600, 603, 607, 611, 430/613, 570

See application file for complete search history.

(56) References Cited

U.S. PATENT DOCUMENTS

| | | | | |
|---|---|---|---|---|
| 4,414,304 | A | 11/1983 | Dickerson | 430/353 |
| 4,740,454 | A | 4/1988 | Deguchi et al. | 430/567 |
| 5,595,864 | A | 1/1997 | Van den Zegel et al. | 430/569 |
| 5,716,769 | A | 2/1998 | Dickerson et al. | 430/521 |
| 5,800,976 | A | 9/1998 | Dickerson et al. | 430/567 |
| 5,811,229 | A | 9/1998 | Van den Zegel | 430/517 |
| 5,955,249 | A | 9/1999 | Adin et al. | 430/502 |
| 6,342,338 | B1 | 1/2002 | Verbeeck et al. | 430/502 |
| 6,346,360 | B1 | 2/2002 | Verbeeck et al. | 430/139 |
| 6,348,293 | B1 | 2/2002 | Verbeeck et al. | 430/139 |

FOREIGN PATENT DOCUMENTS

| | | |
|---|---|---|
| EP | 0 844 520 | 5/1998 |
| EP | 1 103 847 | 5/2001 |
| EP | 1 103 848 | 5/2001 |
| EP | 1 103 849 | 5/2001 |
| EP | 1 103 850 | 5/2001 |
| EP | 1 184 717 | 3/2002 |
| EP | 1 262 824 | 12/2002 |
| EP | 1 262 825 | 12/2002 |
| GB | 1033698 | 6/1966 |

OTHER PUBLICATIONS

European Search Report, EP 03 10 1808, Nov. 13, 2003, West.
Patent Abstracts of Japan, 10-274824, Oct. 13, 1998.

*Primary Examiner*—Geraldine Letscher
(74) *Attorney, Agent, or Firm*—Joseph T. Guy; Nexsen Pruet, LLC

(57) ABSTRACT

A green-sensitized black-and-white silver halide negative working photographic material comprising a support having thereon at least one light-sensitive silver halide emulsion layer containing tabular silver halide grains, further comprising in said emulsion layer or in a layer adjacent thereto, a heteroatomic sulfinic acid compound, a disulfide compound or a combination thereof, wherein each of said compounds has a solubilizing group having a $pK_a$-value of 10 or less.

74 Claims, No Drawings

RADIOGRAPHIC SILVER HALIDE PHOTOGRAPHIC MATERIAL HAVING A GOOD DEVELOPING SPEED, AN EXCELLENT IMAGE TONE AND LOW RESIDUAL COLOR AFTER PROCESSING

FIELD OF THE INVENTION

The present invention relates to a solution for speed, covering power, image tone and residual color of silver halide photographic materials for radiographic imaging.

BACKGROUND OF THE INVENTION

Since the early eighties practical use of light-sensitive tabular silver halide grains or crystals has become common knowledge for anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 μm as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,595,864.

In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape as applied before practical application of said tabular grains, there remains the need to provide an acceptable image tone after development of materials having light-sensitive silver halide layers containing said tabular grains. Reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images. Measures taken in order to get a shift in image tone from reddish-brown to the desired bluish-black color of the developed silver, well-known from the state-of-the-art are hitherto unsatisfactory. Coating light-sensitive emulsion layers on a blue base as in U.S. Pat. No. 5,800,976 makes increase minimum density, a phenomenon which is interpreted by the radiologist as an undesired increase of "fog density". Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen, with residual color of dyes due to uncomplete removal of said dyes in, nowadays desired, rapid processing steps and problems related with criticality of generation of imagewise developed blue colored silver and preservation characteristics of the material.

Radiographic elements exhibiting increased covering power and colder image tones have been published in U.S. Pat. Nos. 5,795,795; 5,800,976 and 5,955,249.

More recently very effective measures in order to improve image tone have been described in EP-A's 1 103 847, 1 103 848, 1 103 849 and 1 103 850.

The stringent demand thus remains to get a desired blue-black image tone of a diagnostic image without disturbing residual color obtained after processing of the radiographic light-sensitive silver halide film material, wherein the said material has suitable preservation characteristics before use. Besides attempts in order to optimize the relationship between image tone, covering power and improved preservation characterics made in EP-A's 1 262 824 and 1 262 825 and in U.S. Pat. Nos. 6,348,293; 6,346,360 and 6,342,338; U.S. Pat. No. 4,740,454 is referred to as relating to a silver halide photographic material having improved sharpness over a wide range from the high frequency area to the low frequency area.

OBJECTS AND SUMMARY OF THE INVENTION

Therefore, an object of the present invention is to provide radiographic film materials with high enough covering power (high density per gram of developed silver halide), without coating higher amounts of silver bromoiodide tabular grains.

A further object of the present invention is to provide a black-and-white radiographic silver halide photographic material wherein no burden is laid on developability of the tabular grains and diagnostic image obtained therewith after processing, more particularly with respect to residual color of the green-sensitized silver halide radiographic material, coated with huge amounts of spectral sensitizer, wherein said spectral sensitizer is adsorbed onto the large specific surfaces of the tabular grains and wherein said grains are coated into one or more light-sensitive layer(s).

Other objects of the present invention will become apparent from the following detailed description and from the Examples.

The above-mentioned advantageous effects have been realized by providing a black-and-white silver halide negative working photo-graphic material having the specific features set out in claim 1. Specific features for preferred embodiments of the invention are set out in the dependent claims.

Further advantages and embodiments of the present invention will become apparent from the following description.

As an advantageous effect presence in said emulsion layer having green-sensitized tabular grains as defined in the description and in the claims, or in a layer adjacent thereto, of a heteroatomic sulfinic acid compound, a disulfide compound or a combination thereof, wherein each of said compounds has a solubilizing group having a $pK_a$-value of 10 or less, provides an improved speed and covering power, besides less residual color after processing in green-sensitized film materials coated with tabular grain emulsions in at least one light-sensitive layer thereof.

DETAILED DESCRIPTION OF THE INVENTION

According to the present invention a black-and-white silver halide negative working photographic material comprising a subbed transparent support, and, in order, at one or both sides thereof, at least one light-sensitive silver halide emulsion layer, and a protective layer, wherein said material is spectrally sensitized in the wavelength range from 540–570 nm, and at least one light-sensitive emulsion layer thereof comprises tabular grains having a thickness in the range from 0.04 μm up to 0.20 μm, wherein said grains having an aspect ratio in the range from 5:1 up to 50:1 (more preferably between 5:1 and 25:1) represent a projective surface area of at least 70% of the total projected surface of all grains present in said emulsion layer(s), and wherein said material further comprises at least one compound according to general formula (I)

(I)

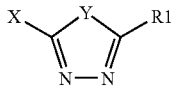

wherein:

X represents a functional group containing sulfur, apart from a thiol group or a thiolate;

Y is selected from the group consisting of an oxygen atom, a sulfur atom, $NR^2$, $NNR^3R^4$ and $N—N{=}CR^5R^6$, $R^1$ is selected from the group consisting of hydrogen, a (substituted or unsubstituted, satured or unsatured) aliphatic or heteroatomic group, a (substituted or unsubstituted) aryl or heteroaryl group, $S—R^7$ and $NR^8R^9$;

$R^2$, $R^5$, $R^6$ and $R^7$ are selected from the group consisting of hydrogen, a (substituted or unsubstituted, satured or unsatured) aliphatic or heteroatomic group, a (substituted or unsubstituted) aryl or heteroaryl group;

$R^3$, $R^4$, $R^8$ and $R^9$ are selected from the group consisting of hydrogen, a (substituted or unsubstituted, satured or unsatured) aliphatic or heteroatomic group; a (substituted or unsubstituted) aryl or heteroaryl group, an acyl group, a sulphonyl group and a phosphoryl group;

wherein any of $R^3$ and $R^4$, $R^5$ and $R^6$, $R^8$ and $R^9$ may represent atoms necessary to form a five to eight membered, and wherein $R^1$ and Y may form a five to eight membered ring, further characterized in that at least one of Y and $R^1$ is substituted by a solubilizing group having a $pK_a$ of 10 or less.

In one embodiment according to the present invention a silver halide material comprises a compound according to general formula (I), wherein X— is represented by a group according to formula (II), (II)

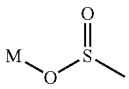

wherein M represents a hydrogen atom or a counterion.

In another embodiment according to the present invention a silver halide material comprises a compound according to general formula (I), wherein in said X— is represented by a group according to formula (III), (III)

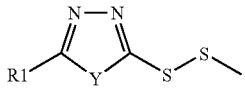

wherein Y and $R^1$ in formula (III) are defined as in general formula (I) given hereinbefore.

In a more preferred embodiment according to the present invention said silver halide photographic material further comprises a compound according to general formula (IV), (IV)

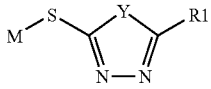

wherein Y and R1 are defined for formula (I) and wherein M represents a hydrogen atom or a counterion.

According to a preferred embodiment of the present invention said silver halide photographic material comprises at least one compound as disclosed hereinbefore, wherein said characterizing solubilizing group is selected from the group consisting of a carboxylic acid or salt thereof, a sulfonic acid or salt thereof, a phosphonate, a phosphate, a sulfate and an acylsulfonamide or salt thereof.

In a further preferred embodiment according to the present invention a silver halide photographic material as disclosed hereinbefore comprises at least one compound, wherein Y is a sulfur atom.

In another preferred embodiment said silver halide photographic material as disclosed hereinbefore comprises at least one compound according to the formulae given hereinbefore, wherein $R^1$— is represented by formula (V), (V)

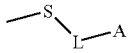

wherein:

A is a solubilizing group selected from the group consisting of a carboxylic acid, a sulfonic acid, a phosphonate, a phosphate, a sulfate and an acylsulfonamide or a corresponding salt thereof, and L represents a (substituted or unsubstituted) aliphatic divalent linking group.

Typical examples of compounds according to general formula II are given below without being limited thereto.

II-1

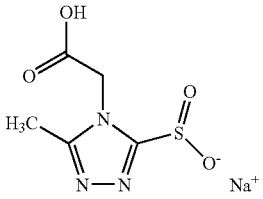

-continued

II-2

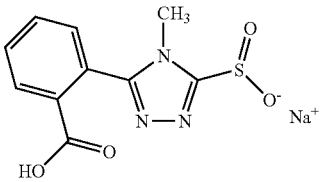

II-3

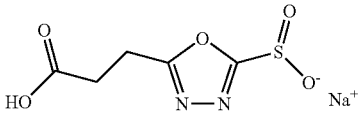

II-4

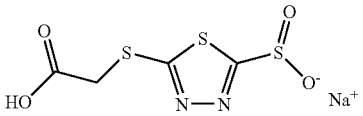

II-5

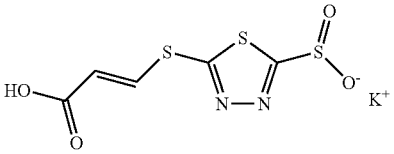

II-6

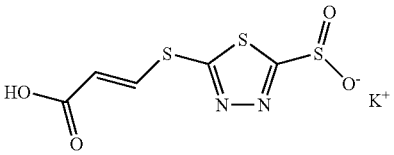

II-7

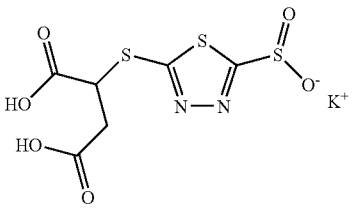

II-8

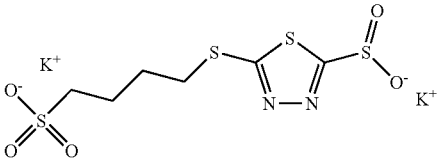

II-9

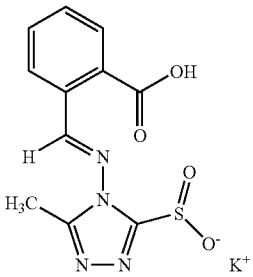

II-10

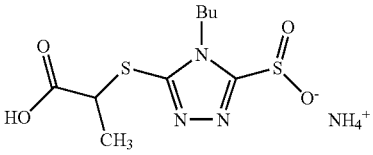

-continued

II-11

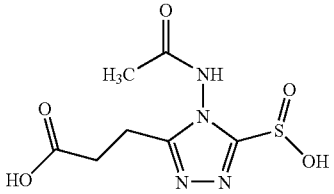

II-12

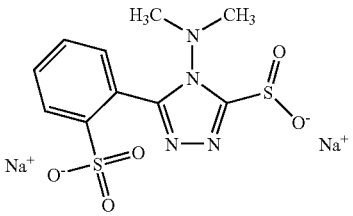

II-13

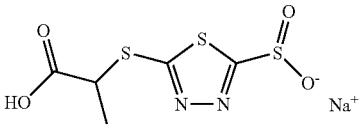

Several strategies with respect to the synthesis of heteroaromatic sulfinic acid salts have been published. Making use of thioureum dioxide as a starting material is a typical synthetic strategy, especially used for six-membered heterocyclic sulfinic acids, as has been published e.g. by Taylor et al. (Tetrahedron 23, 2081–2093 (1967)). For five and six membered heteroaromatic sulfinic acids, several oxidative methods have been published (Chem. Pharm. Bul. 36(7), 2652–2653 (1988); Helvetica Chimica Acta, 69(3), 708–717 (1986); Helcetica Chimica Acta, 69(5), 1095–1106 (1986); J. Med. Chem. 7(6), 792–799 (1964); Chem. Ber., 93, 1590–1597 (1960)). Addition of $SO_2$ to deprotonated heterocycles has also been described (J. Org. Chem. 56(13), 4260–4263 (1991)). It has advantageously been decided to take a synthetic approach making use of disproportiona-tion of symmetrical disulfides in an alkaline medium, similar to the mechanisms proposed by Barton et al. (Tetrahedron Letters 31(7), 949–952 (1990)) for the carboxylate induced disproportionation of symmetrical disulfides.

It has further advantageously been decided to first prepare the symmetrical disulfides and to convert them, at least partially, into the sulfinic acid salts upon dissolving them in an alkaline medium.

compound II-1

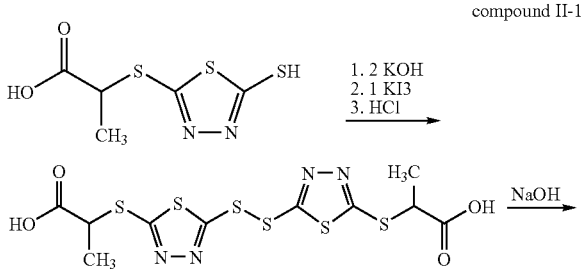

-continued

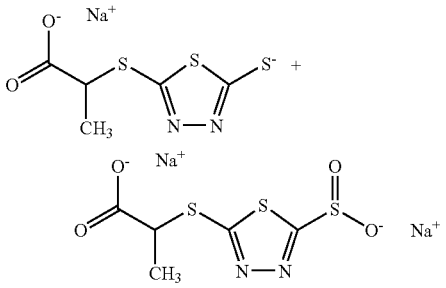

This has been illustrated for compound II-1 as given hereinafter.

A mechanism, illustrative for the disproportionation reaction has been given in the next scheme hereinafter, omitting therein a potential carboxylate catalysis:

The aqueous solution obtained after dissolving the disulfide in alkaline medium was analysed with NMR and mass spectroscopy: both spectroscopic techniques were unambiguously confirming the composition as anticipated from the proposed mechanism.

The solution can be used as such in photographic applications

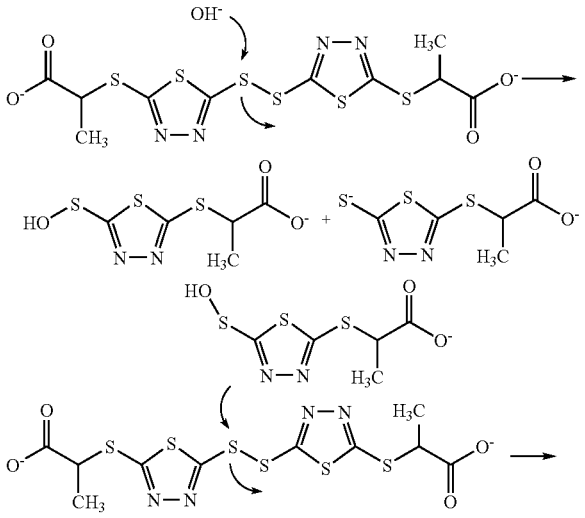

-continued

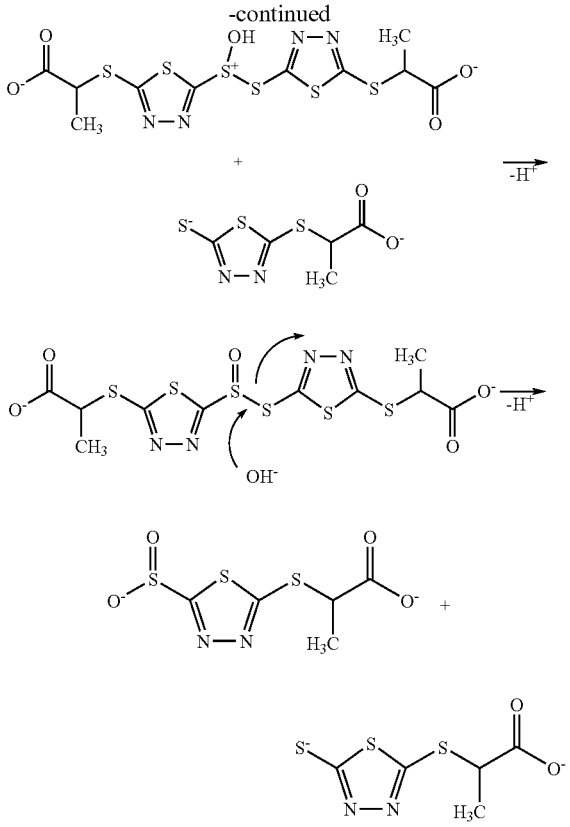

without isolating the sulfinic acid.

In a further preferred embodiment the said silver halide material comprises at least one heteroaromatic disulfide, in that in said compound according to general formula (I), X— is represented by a group according to general formula (III),

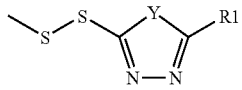

(III)

wherein Y and R1 are defined as in general formula (I).

Typical examples of compounds according to general formula (III) are given below, without being limited thereto.

(III-1)

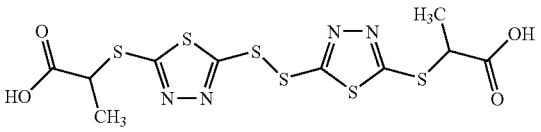

(III-2)

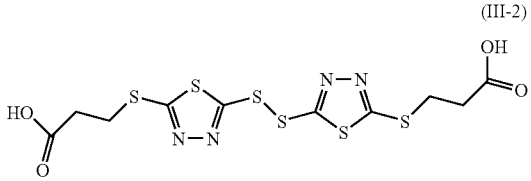

-continued
(III-3)
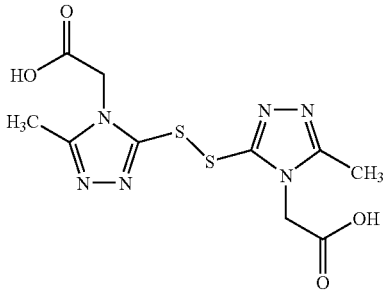
(III-4)
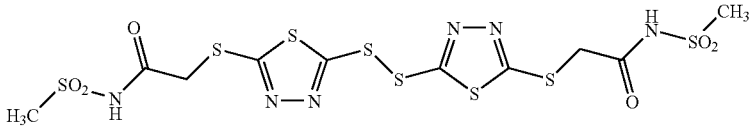
(III-5)
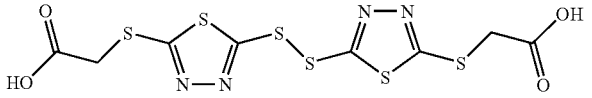
(III-6)
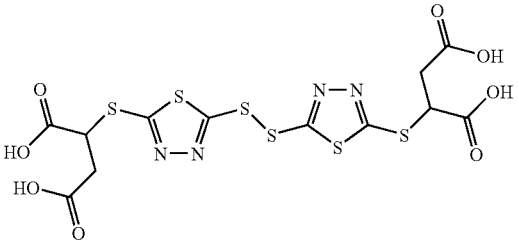
(III-7)
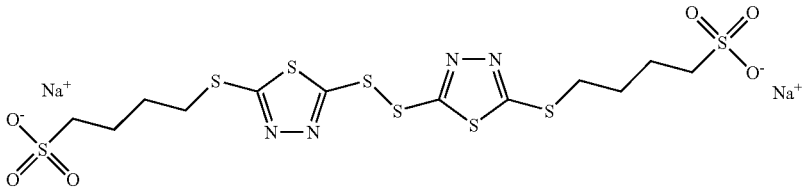
(III-8)
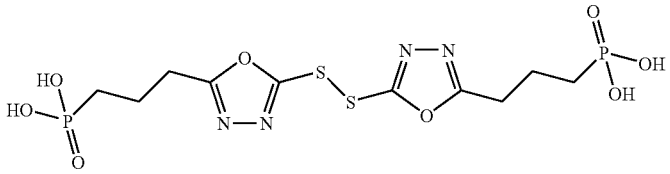
(III-9)
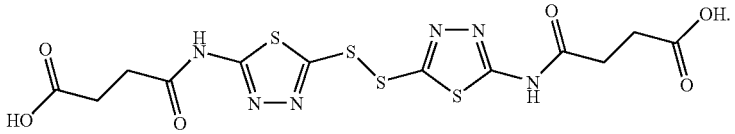

-continued (III-10)

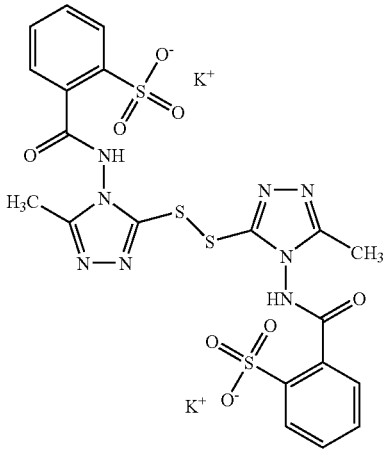

According to the present invention X in general formula (I) is therein advantageously obtained by the method of oxidation of the corresponding thiol or thiolate, so that X represents a functional group containing sulfur, apart from a thiol group or a thiolate.

According to the present invention in a silver halide photographic material as disclosed hereinbefore at least one of the compounds (I), (II) and (III) is present in the light-sensitive silver halide emulsion layer or in a layer adjacent thereto, in an amount from $10^{-6}$ to $10^{-1}$ mol per mol of silver halide, more preferably from $10^{-4}$ to $10^{-1}$ mol and even more preferred from 0.4 mmol to 0.1 mol per mol of silver halide.

Furtheron according to the present invention a silver halide photographic material is provided, wherein the coating amount of the tabular silver halide grains, expressed as an equivalent amount of silver nitrate, is in a range of from 0.1 to 6 g/m$^2$.

According to the present invention a method is offered of preparing a silver halide photographic material by coating on a support at least one light-sensitive silver halide emulsion layer containing tabular silver halide grains having a thickness in the range from 0.04 μm up to 0.20 μm, wherein said grains having an aspect ratio in the range from 5:1 up to 50:1 (and more preferably between 5:1 and 25:1) represent a projective surface area of at least 70% of the total projected surface of all grains present, by adding to a coating solution, in water at ambient temperature, a solution of a heterocyclic disulfide according to formula (III) as disclosed hereinbefore, to which an equivalent amount of an inorganic base is added.

In the layer arrangement used for the black-and-white silver halide negative working photographic material, on at least one side of a subbed support at least one light-sensitive layer is present, wherein said layer is, optionally, overcoated with a non-light sensitive intermediate layer, and sandwiched between an outermost non-light sensitive protective topcoat or antistress layer (coated over said optionally present intermediate layer) and, optionally present, a non-light sensitive intermediate layer coated onto the said subbed support and coated between light-sensitive layer(s) and subbed support (called "undercoat layer").

In a preferred embodiment said film material is a radiographic single-side coated or double-side coated (also called duplitized) material.

The protective antistress layer(s) of the said radiographic material, according to the present invention, may be the outermost layers of the material, but an outermost afterlayer may optionally be present as disclosed e.g. in EP-A's 0 644 454 and 0 644 456, wherein e.g. a synthetic clay is present in favor of pressure resistance. Even a spray-coated layer may be present.

Moreover protective antistress layers may be coated as two adjacent layers, wherein, in one embodiment, preferably the layer coated adjacent to the emulsion layer should include at least one compound according to the formulae of a heteroatomic sulfinic acid compound, a disulfide compound or a combination thereof, wherein each of said compounds has a solubilizing group having a $pK_a$-value of 10 or less as claimed. Protective antistress layers, besides their function as protection layer may include compounds providing better antistatic properties as has been disclosed e.g. in EP-A 0 644 454 (with polyoxyalkylene compounds as antistatic agents), in EP-A's 0 505 626, 0 534 006 and 0 644 456. As said layers are in most cases outermost layers, their contribution to satisfactory surface characteristics of the processed film material is very important, e.g. from the point of view of an excellent surface glare as desired by examining medecins, as has been described in EP-A's 0 806 705 and 0 992 845.

When an antihalation undercoat is present as suggested above, described in e.g. U.S. Pat. Nos. 5,077,184 and 5,693,370, the said compound(s) according to the formulae given above may be present therein, particularly if the said compound would be absent in the emulsion layer and in the protective antistress layer(s).

It has been established now that presence of one or more compounds satisfying the formulae (I) to (IV) in one or more (hydrophilic) non-light-sensitive layers (like the protective antistress layers and/or antihalation undercoat layers) adjacent to the light-sensitive silver halide emulsion layers of the (radiographic) material of the present invention further improves image tone in that a "colder" blue-black image is obtained as desired by medecins examining radiographs for at least the same, and even an increased covering power.

The light-sensitive (photosensitive) layers of the film material of the present invention coated on one or each of the major surfaces of the subbed support, optionally provided with an antihalation undercoat, thus contain chemically and spectrally green-sensitized tabular grains having a thickness in the range from 0.04 μm up to 0.20 μm, wherein said grains having an aspect ratio in the range from 5:1 up to 50:1 represent a projective surface area of at least 70% of the total projected surface of all grains. Preferably said tabular grains are {111} tabular hexagonal silver halide emulsion grains or crystals rich in silver bromide in an amount covering at least 70%, and more preferably at least 90% of the total projective surface of all grains, wherein the said tabular grains have a mean or average equivalent volume diameter of from 0.3 μm up to 1.0 μm.

In one embodiment preferred average thicknesses of the tabular grains are in the range from 0.06 to 0.15 μm and, even more preferred, with respect to availability of having lower coating amounts of silver, thicknesses in the range from 0.09 to 0.12 μm are envisaged, wherein average aspect ratios of said tabular grains are in the range from 10:1 to 25:1 and, more particularly, in the range from 12:1 to 18:1. Grains having average thicknesses in the range from 0.06 μm to 0.08 μm are not excluded however: such grains are also very useful in this invention and are advantageously prepared as disclosed in U.S. Pat. No. 6,558,892. With respect to homogeneity, it is recommended to have grains showing a standard deviation on the calculated average thickness of said the tabular grain population of not more than 30%, and even more preferably, not more than 20%.

In another embodiment said grains are "core-shell" emulsion grains or crystals, wherein said grains are composed of a silver bromide core and a silver bromoiodide shell having an average amount over the whole crystal volume of more than 90 mole % of silver bromide, and an amount of from 0.05 up to 1.0 mole % of iodide (and more preferably from 0.05 up to 0.5 mole %), based on silver (in the case that only iodide conversion at the grain surface is applied) or an amount of up to 2 and even up to 3 mole % of iodide, based on silver (in the case that an internal shell having more iodide or an outermost shell as a result double-jet precipitation of silver bromo(chloro)iodide, chloride being optional, is applied).

Average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. Percentages of the total projective area of all tabular grains with respect to the total projective area of all grains present in the emulsion layers are calculated from electron microscopic photographs (shadowed replicas). Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean or average aspect ratio of the tabular grains in the emulsion distribution.

The negative-working black-and-white (radiographic) film material according to the present invention thus comprises light-sensitive layers at one or both sides of the film support wherein preferably {111} tabular silver halide grains rich in silver bromide (having at least 90 mole % of silver bromide, based on silver) and silver iodide in the limited amounts as set forth hereinbefore. Preparation methods for {111} tabular grain emulsions rich in silver bromide suitable for use with respect to tabular grains in materials of the present invention can be found in Research Dislosure No. 389057, p. 591–639 (1996), more particularly in Chapter I. A very useful method has e.g. been described in EP-A 0 843 208. Iodide ions added during precipitation, in a more preferred embodiment at the surface of al {111} tabular hexagonal grains, are provided in the preparation method by addition of an inorganic iodide salt as potassium iodide, thus causing conversion. More preferred as providing slower liberation of iodide in the reaction vessel is addition of organic agents releasing iodide ions in order to provide the low silver iodide concentrations, not exceeding 1 mole % and even more preferably not exceeding 0.5 mole %, based on silver and calculated as an average value over het whole grain volume. Addition of iodide by organic agents releasing iodide ions has been described e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663.

In another embodiment addition of iodide to emulsion grains rich in silver bromide (having a preferred silver bromoiodide composition) is performed by adding fine preformed grains of silver iodide, whether or not including bromide (and/or, optionally, chloride in minor amounts), said grains having a grain diameter of not more than 100 nm, and more preferably, not more than 50 nm. Such fine grains are so-called "Lippmann" emulsions. Addition of iodide making use from such fine grains rich in silver iodide (or even pure silver iodide) has been described for the preparation of {111} tabular grains in JP-A's 04-251241 and 08-029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of fine AgI-Lippmann emulsions to the surface of the silver halide crystals in order to get a global iodide content in the range from 0.05 up to 0.5 mole % over the whole grain volume may advantageously proceed as disclosed in EP-A 0 475 191, wherein an excellent speed/fog ratio and a high covering power are attained.

The material according to the present invention invention thus has, in a preferred embodiment, silver halide grains composed of silver bromoiodide.

Preparation of the {111} tabular grain emulsions is performed in the presence of gelatin or colloidal silica sol as a binder providing colloidal stability during all preparation steps.

In one embodiment the precipitation of the tabular silver halide crystals is performed in the presence of a protective, hydrophilic colloid, as e.g. conventional lime-treated or acid treated gelatin, but also oxidized gelatin (see e.g. EP-A 0 843 208, which is incorporated herein by reference) or a synthetic peptizer may be used. As a result tabular grains in the light-sensitive silver halide emulsion layer are dispersed in a hydrophilic polymeric vehicle mixture comprising at least 0.5% of oxidized gelatin, based on the total dry weight of said polymeric vehicle mixture, i.a. about 2% and even up to about 4%. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, beside dyes (even spectral sensitizing dyes e.g.) or crystal habit modifiers, other grain growth restrainers or accelerators may also be used during the precipitation, together with the flow rate and/or concentration variations of the silver and halide salt solutions, the temperature, pAg, physical ripening time, etc. Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps. Another well-known washing technique is ultrafiltration or diafiltration. Finally, extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0 is then obtained.

It is clear that {111} tabular silver halide emulsion grains, present in light-sensitive emulsion layers of materials according to the present invention, are, besides spectrally sensitized in the green wavelength range of the visible spectrum and more preferably in the range between 540 and 570 nm, also chemically sensitized, at least with a combination of labile chalcogen compounds and gold compounds, more preferably with compounds providing sulphur, selenium (without even excluding tellurium) and gold. Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds have been disclosed in EP-A's 0 831 363, 0 889 354 and 0 895 121. Said labile selenium compounds are common-ly applied in combination with sulphur and gold, and so are labile tellurium compounds as has been disclosed e.g. in EP-A 1 070 986.

Preparation of spectrally and chemically sensitized tabular grains as may be applied to emulsion grains to be coated light-sensitive layers of a radiographic material according to the present invention by performing spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Disclosure No. 389057, p. 591–639 (1996), as in Chapter VII about antifoggants and stabilizers, in Chapter VIII about coating physical property modifying addenda, in Chapter XI about layer arrangements and in Chapter XV about supports.

In one embodiment according to the present invention a duplitized film material comprises light-sensitive emulsion layers coated on both sides of a subbed support (i.a. a support coated with good adhesion providing subbing layers) with, optionally, inbetween said subbing layers and the light-sensitive layers coated thereupon, a hydrophilic non-light-sensitive layer, e.g. comprising antihalation dyes providing less cross-over and thus a better sharpness as described e.g. in U.S. Pat. Nos. 5,344,749; 5,478,708; 5,811,545 and 5,811,546.

The material according to the present invention has emulsion grains which have been made sensitive to the green range of the wavelength spectrum, more particularly in the wavelength range from 540 to 570 nm. The film material, advantageously used as radiographic material, thus has at least one emulsion comprising hexagonal {111} tabular silver halide grains rich in silver bromide (silver bromoiodide, optionally containing chloride in amounts of less than 10 mole % based on silver), spectrally sensitive to irradiation in the green wavelength range by the presence of at least one J-aggregating spectrally sensitizing tri-methine cyanine dye according to the general formula given in EP-A 0 678 772 and 0 953 867, wherein e.g. trimethine benzoxazoles and imidazoles are used apart or in combination, and of at least one dye selected from the group consisting of monomethine cyanine dyes and azacyanine dyes mentioned hereinfore. Therefore in one embodiment radiation-sensitive emulsions having silver bromoiodide grains, as in the present invention, sensitive to irradiation in the wavelength range between 540 and 570 nm, are made sensitive thereto by the presence of a J-aggregating spectrally sensitizing cyanine dye as the particularly preferred J-aggregating orthochromatic oxacarbocyanine dyes anhydro-5,5'-dichloro-3,3'-bis(n-sulpho-butyl)-9-ethyloxacarbocyanine hydroxide and anhydro-5,5'-dichloro-3,3'-bis(n-sulphopropyl)-9-ethyloxacarbocyanine hydroxide. Furthermore green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related with the purpose of obtaining the highest possible photographic speed while reducing possible dye stain, due to the presence at the tabular grain surfaces of huge amounts of adsorbed dyes, which may cause residual coloration after processing, especially in rapid processing cycles.

Duplitized film materials (defined as materials having radiation-sensitive emulsions layers, coated at both sides of the material support), particularly suitable for use in radiographic applications, are irradiated by the light emitted imagewise by X-ray intensifying screens after conversion of X-ray radiation to the said light by luminescent phosphors coated in the said screens or panels, in intimate contact therewith at both sides of the coated film support during X-ray is exposure of part of a patient. A diagnostic silver image, in conformity with the X-ray image, is obtained after processing of the said film material. During X-ray exposure irradiation of said film is arranged in a cassette between two X-ray intensifying screens each of them making contact with its corresponding light-sensitive side, thus forming a film/screen system. In another embodiment said film is in contact with one single X-ray intensifying screen in case of a single-side coated radiographic material.

In one embodiment a radiographic screen/film combination or system is thus provided, said system comprising a radiographic film material as disclosed herein in contact with one supported or self-supporting X-ray intensifying screen or sandwiched between a pair of said screens, wherein said intensifying screen or screens comprise(s) luminescent phosphor particles emitting at least 50% of their emitted radiation in the wavelength range for which said material has been made spectrally sensitive, i.a. in the green wavelength range of the visible spectrum between 540 and 570 nm.

A radiographic screen/film combination or system is thus provided comprising a duplitized film material, sandwiched between a pair of supported or self-supporting X-ray intensifying screens, wherein i) said pair of supported or self-supporting X-ray intensifying screens essentially consists of luminescent phosphor particles emitting at least 50% of their emitted radiation in the green wavelength range from 540 nm to 570 nm, as e.g. a terbium doped gadolinium oxysulfide phosphor (without being limited thereto);

ii) said film comprises {111} tabular silver halide grains rich in silver bromide, spectrally sensitive to irradiation in the said wavelength range from 540 to 570 nm by the presence of at least one J-aggregating green spectral sensitizer and, optionally, of at least one the non-J-agregating dyes selected from the group consisting of azacyanine dyes and monomethine cyanine dyes, wherein said emulsion is present in at least one light-sensitive emulsion layer on at least one side of the film support. The well-known $Gd_2O_2S$:Tb luminescent phosphor coated in the X-ray conversion screen used in a film/screen system sensitive to (visible) green light and emitting light in the wavelength range from 540 tot 555 nm has been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for particular-ly suitable for use in the context of the present invention.

In the context of the present invention, more particularly with respect to the purposes to get reduced dye stain, also called residual color, and an excellent image tone, said reduced dye stain delivering an indispensible asset thereto, azacyanine dyes may advantageously be used in the preparation of {111} tabular grain emulsions as the presence of said dyes permits further addition of J-aggregating spectral sensitizers in lower amounts, without loss in speed, thereby providing better decoloration in the processing. A survey of other useful chemical classes of J-aggregating spectral sensitizers suitable for use in spectrally sensitizing emulsions of the present invention has been described by F. M. Hamer in "The Cyanine Dyes and Related Compounds", 1964, John Wiley & Sons and other examples specifically useful for spectral sensitization of tabular grains have been given in Research Disclosure Item 22534 and in addition a more recent overview has been given in EP-A 0 757 285, wherefrom dyes forming J-aggregates on the flat surface of the preferred silver bromide or silver bromoiodide crystals are particularly recommended.

In a further embodiment, and more particularly in materials having tabular grains with an average thickness in the range from 0.06 μm–0.12 μm as e.g. average thicknesses of 0.07 μm or 0.10–0.11 μm, it has been established that presence of fine grains, rich in silver iodide, in the protective antistress layer or in a non-light-sensitive hydrophilic intermediate layer (interlayer) between a light-sensitive layer and said protective antistress layer is in favor of developability of the silver halide material. Alternatively said fine grains are present in an intermediate layer (called "undercoat layer") between subbing layer of the support and emulsion layer coated thereupon. Said fine grains, rich in silver iodide, whether or not including bromide (and/or, optionally, chloride in minor amounts), may be the same as used in the preparation step of the tabular silver bromoiodide grains as disclosed hereinbefore: recommended grain diameters of said fine silver iodide grains are not more than 100 nm, and more preferably, not more than 50 nm, e.g. 0.040 μm or 0.050 μm. Preferred amounts of said fine grains rich in silver iodide to be coated in the hydrophilic intermediate layer between light-sensitive layer and outermost protective layer are in the range from 0.3 to 0.6 g/m$^2$, and, more preferably in the range from about 0.4 to 0.5 g/m$^2$, wherein said amounts are expressed as equivalent amounts of silver nitrate. In a preferred embodiment said fine iodide grains are thus present in layers, adjacent to an emulsion layer. An additional advantage offered by the presence of fine silver iodide grains or crystals in a layer of the film material as disclosed hereinbefore is the disappearance of processing artefacts, due to physical pressure phenomena while developing exposed tabular grains therein, when contact is made of the wet film and rollers in some types of developing machines: strikes appearing due to a decrease in density on the developed film as a consequence of this physical pressure phenomenon completely disappear!

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/for-maldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as an optionally present antihalation undercoat between the subbing layer and the emulsion layer as has e.g. been described in U.S. Pat. Nos. 5,077,184 and 5,693,370. The presence of such dye(s) in adapted amounts in an emulsion layer can even be recommended in order e.g. to adjust the sensitivity of the emulsion layer(s) or the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersion of water insoluble dyes having a mean particle diameter of less than 10 μm, more preferably less than 1 μm and still more preferably less than 0.1 μm. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods, useful in the context of the present application has been described in EP-A 0 756 201.

The silver halide emulsions used in light-sensitive layers of the material according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethio-sulphinic acid and benzenethiosulphonic acid amide.

Other compounds which can be used as fog-inhibiting compounds are those described in Research Disclosure No. 17643 (1978), Chapter VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelera-tors are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth) acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides (see e.g. EP-A 0 890 874) or a polymer latex and the like or polymers providing permanent antistatic properties as polyethylene dioxythiophenes (PEDT) described e.g. in U.S. Pat. Nos. 5,312,681; 5,354,613 and 5,391,472; and in EP-A 1 031 875.

According to the present invention a method of image formation is further advantageously applied by consecutively performing the steps of exposing to X-rays the radiographic screen/film combination or system described hereinbefore; followed by processing the film according to the present invention by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present. As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso) ascorbic acid, 1-ascorbic acid and tetramethyl reductic acid are preferred as main developing agent in the developer. Said developing agents which are especially suitable for use, have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

In order to reduce "sludge formation" which is favored by solubilizing agents like sulphites, present in the developer as preservatives, a particularly suitable developer solution is the one comprising a reduced amount of sulphite and ascorbic acid which acts as a main developer and antioxidant as well and which is called "low-sludge" developer. Suitable measures taken therefore have recently been described in U.S. Pat. Nos. 6,238,853 and 6,238,854.

Processing cycles wherein no boron compounds are used, are particularly interesting from an ecological point of view as has been described in EP-A 0 908 764 and the corresponding U.S. Pat. No. 6,083,672. So in favor of ecological fixation presence of aluminum ions should be reduced, and more preferably, no aluminum ions should be present. This is moreover in favor of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of α-ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

As already set forth hereinbefore single-side coated materials are also envisaged in the present invention, such as in combination with a single screen having luminescent phosphors with a high prompt emission of fluorescent light on X-ray irradiation and low afterglow in favor of image sharpness, suitable for use in mammography, wherefore the relationship between resolution and speed of X-ray intensifying screens has been described e.g. in Med. Phys. 5(3), 205 (1978).

Other single-side coated materials wherein the emulsions can advantageously applied, e.g. with respect to preservation properties, developability, etc. are black-and-white silver halide material used e.g. in micrography, in aviation photography, in black-and-white cinefilms, in laserfilms or hardcopy films and in graphic or reprographic applications.

EXAMPLES

While the present invention will hereinafter be described in connection with preferred embodiments thereof, it will be understood that it is not intended to limit the invention to those embodiments.

Example 1

Preparation of the Tabular Emulsion

To a solution of 15.0 g of an oxidized gelatin and 2.85 ml of a 2.96 molar solution of potassium bromide in 1.4 l of demineralized water at 45° C., adjusted to a pH of 2.0 by adding $H_2SO_4$, stirred up to a rate of 600 r.p.m., were added by a double jet method aqueous solutions of 2.96 M $AgNO_3$ (hereinafter referred to as A1) and 2.96 M KBr (hereinafter referred to as B1): 10 ml of A1 and 10 ml of B1 were added in a time interval of 30 seconds. When the addition was completed, the temperature was increased up to 60° C. over a period of 19 minutes: UAg was controlled (expressed in mV versus a Ag/AgCl(sat.) reference electrode and should be in the range from 37.9±5.0 mV at a temperature of 60° C.±1° C. 1 minute later pH was set to a value of 5.0±0.3 and immediately thereafter a solution of 50 g of inert gelatin in 500 ml of demineralized water of 60° C. was added. 3 minutes later B1 was added at a rate of 5.0 ml/min. during 120 seconds. In a further double jet addition A1 and B1 were added during 7251 seconds at a linearly increasing rate going from 1.5 up to 15.04 ml/min. for A1 and from 1.51 up to 15.18 ml/min. in order to maintain a constant UAg potential of 0 mV in the reaction vessel. After that double-jet addition period, 40 ml a 0.3 molar solution of potassium iodide solution was added to the reaction vessel in order to get a total AgI content at the end of precipitation of 0.4 mole % vs. silver precipitated.

The average grain size of the silver bromoiodide tabular {111} emulsion grains thus prepared, expressed as equivalent volume diameter, was 0.56 μm, the average thickness was 0.105 μm.

After washing, gelatin and water were added in order to obtain a silver halide content of 235 g/kg, expressed as AgNO3, and a gelatin content of 117.5 g/kg. To the emulsion having a weight of 2125 g, the

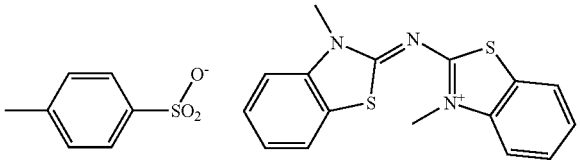

pH of which was adjusted to 5.5, was added consecutively 4 ml of a 10 wt. % KSCN solution, 50 mg (1 wt % solution, dissolved in 50 ml of methanol), of the azacyanine dye corresponding with the formula given hereinafter, followed by addition, after 5 minutes of 2 ml of a $4.76\times10^{-3}$ M solution of sodium toluenethiosulphonate in methanol, further followed by addition after 5 minutes of 1500 ml of a 0.25 wt. % solution of anhydro-5,5'-dichloro-3,3'-bis(n-propyl-3-sulphonate)-9-ethyl-benzoxa-carbocyanine triethylammonium salt, 6 mg of sodium thiosulphate dissolved in 10 ml of demineralized water at 35° C., 7 ml of a 0.01 wt. % solution of 2-carboxyethyl-N-benzothiazine selenide, 8 ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercaptotetrazole.

The emulsion sample was chemically ripened at 50° C. during a time in order to get the best compromise between fog and sensitivity. After cooling phenol was added as a preservative.

Coating of the Materials

Preparation of the Film Material.

In order to prepare the coating composition of the light-sensitive silver halide emulsion layer, wherein an average total amount of 4.5 g of silver nitrate per $m^2$ were coated. As stabilizers in the emulsion layer coatings 0.1 mmole of 1-(m-carboxymethylthioacetamido)-phenyl-5-mercaptotetrazole and 0.6 mmole of 5-methyl-1,2,4-triazolo-(1,5-A)-pyrimidine-7-ol were added per mole of silver. Resorcinol was further added as hardener stabilizer in an amount of 2.8 g per mole of Ag. Consecutively 0.1 g of polyglycol (MW=8000) was added as a development accelerator; 5 ml of polyoxyethylene surfactant $H_{17}C_8$-Phenyl-(O—$CH_2$—$CH_2$)$_8$—O—$CH_2$—COOH and in an amount of 400 mg (per mole of Ag) fluoroglucinol was added as a hardener accelerator together with polyethyl acrylate latex (in an amount of 14.1 g/mol silver) which was used as a plasticizer.

The thus prepared emulsion coating solutions were coated on a blue colored polyethylene terephthalate support (density of the support measured to be 0.180).

The following protective layer was coated thereupon (pH value: 6.25) at both sides:

Composition of the protective antistress layer

| | |
|---|---|
| Gelatin | 1.11 g/$m^2$ |
| Graft copolymer (1) | 21 mg/$m^2$ |
| Chromium acetic acid | 5.4 mg/$m^2$ |
| Compound (2) | 12 mg/$m^2$ |
| Compound (3) | 6 mg/$m^2$ |
| Mobilcer Q (MMM trademarked product) | 0.025 ml/$m^2$ |
| Compound (4) | 10 mg/$m^2$ |
| Compound (5) | 1.5 mg/$m^2$ |
| Compound (6) | 15 mg/$m^2$ |

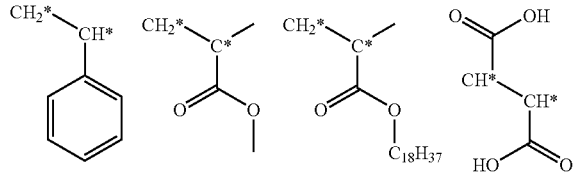

Compound (1)

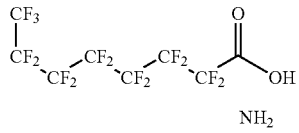

Compound (2)

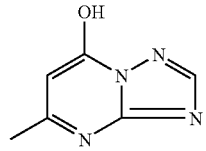

Compound (3)

Compound (4)

Compound (5)

-continued

Composition of the protective antistress layer

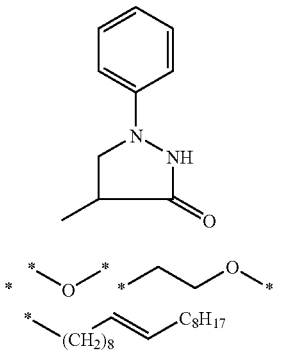

Compound (6)

Samples of coating Materials Nos. 1 to 6 (wherein as Material No. 6 a CURIX ORTHO HTG® film was taken, trademarketed product from Agfa-Gevaert, having no tabular grains but structured twin crystals in its light-sensitive emulsion layers) were exposed with green light of 540 nm during 0.1 seconds using a continuous wedge and were processed.

The processing was run through automatic processing machine or processor HT330® in the developer G138i® and in the fixer G334i®, all of them being trademarketed products from Agfa-Gevaert N.V., Mortsel, Belgium, followed by rinsing at the indicated temperature of 33° C. for a total processing time of 90 seconds.

Following parameters are given in the Table 1:

Fog "F", given as an integer after having multiplied the real fog density as measured with a factor of 1000;

Speed "S", given as an integer after having multiplied the sensitivity measured at a density of 1.00 above minimum density as measured with a factor of 100;—an decrease of speed with a figure of 30 corresponding with a doubling in speed—;

Gradation (contrast) "GG", given as an integer after having multiplied with a factor of 100 the real gradation—contrast—figure as measured between a density of 1.0 and 2.0 above minimum density;

Density latitude "DLT", given as maximum density as measured after subtraction of the density of the support, multiplied with a factor of 100 and a measure for covering power—as coating amounts of silver halide were approximately the same;

Residual (magenta) color "RC", evaluated after processing an unexposed material in same automatic processor, but in a total throughput time of 30 s at a developer temperature of 25° C.

The residual color obtained was measured versus a reference series, characterized by figures, a lower figure being indicative for a lower residual color density.

A compound (cpd) according to the formula III-1 was added to the emulsion layer and expressed in mg/m and per side in Table 1 hereinafter.

TABLE 1

| Matl. No. | x mg cpd/m$^2$ | F | S | GG | DLT | RC |
|---|---|---|---|---|---|---|
| 1 (comp.) | 0 | 218 | 160 | 283 | 378 | 6.0 |
| 2 | 1.4 | 210 | 162 | 283 | 382 | 5.5 |

TABLE 1-continued

| Matl. No. | x mg cpd/m$^2$ | F | S | GG | DLT | RC |
|---|---|---|---|---|---|---|
| 3 | 2.8 | 206 | 165 | 287 | 380 | 5.2 |
| 4 | 4.2 | 205 | 167 | 285 | 378 | 5.0 |
| 5 (inv.) | 5.6 | 205 | 169 | 284 | 380 | 4.0 |
| 6 CURIX ORTHO HTG ® | 0 | 208 | 166 | 286 | 363 | 5.0 |

As becomes clear from the Table 1 an improved (lower) residual color is found for a comparable (up to a lower) fog level, a comparable speed and a comparable contrast for a film having from about 5 mg/m2 (i.a. from about 10–11 μmole of said compound III-1 per m$^2$, thus from about 400 μmole or 0.4 mmole per mole of silver) in the emulsion layer, of a compound as required in order to attain the advantages according to the invention as presented herein.

Example 2

Same materials were coated as in Example 1, except for the presence of an undercoat layer between subbed support and emulsion layer, at both sides of said subbed support. The undercoat layer was provided with gelatin in an amount of 0.08 g/m$^2$ and was further containing in an amount of 0.04 g/m$^2$, expressed as equivalent amount of silver nitrate, silver iodide grains, having an average grain size diameter of about 0.040 μm.

Results obtained with materials without and with a compound according to the formula III-1 have been summarized in Table 2.

TABLE 2

| Matl. No. | x mg cpd/m$^2$ | F | S | GG | DLT | RC |
|---|---|---|---|---|---|---|
| 7 (comp.) | 0 | 213 | 142 | 265 | 355 | 6.0 |
| 8 (inv.) | 3.3 | 202 | 148 | 288 | 363 | 5.2 |
| 9 CURIX ORTHO HTG ® | 0 | 199 | 162 | 269 | 364 | 5.3 |

It is concluded from the figures in Table 2 that presence of silver iodide fine grains in an undercoat layer clearly makes speed to become increased (compare results obtained without fine grains for materials in Table 1 and in the CURIX ORTHO HTG® material.

Presence of compound III-1 makes decrease speed and fog, but has a benificial influence on gradation, density latitude and resi-dual color, of the materials exposed and processed as in Example 1.

Having described in detail preferred embodiments of the current invention, it will now be apparent to those skilled in the art that numerous modifications can be made therein without departing from the scope of the invention as defined in the appending claims.

The invention claimed is:

1. A black-and-white silver halide negative working photographic material comprising a subbed transparent support, and, in order, at one or both sides thereof, at least one light-sensitive silver halide emulsion layer, and a protective layer, wherein said material is spectrally sensitized in the wavelength range from 540–570 nm, wherein at least one light-sensitive emulsion layer thereof comprises tabular grains having a thickness in the range from 0.04 μm up to 0.20 μm, wherein said grains having an aspect ratio in the range from 5:1 up to 50:1 represent a projective surface area of at least 70% of the total projected surface of all grains present in the emulsion and wherein said material comprises at least one compound according to general formula (I):

(I)

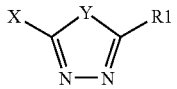

wherein:

X represents a functional group containing sulfur, apart from a thiol group or a thiolate;

Y is selected from the group consisting of an oxygen atom, a sulfur atom, $NR^2$, $R^1$ is selected from the group consisting of hydrogen, a heteroatomic group, an aryl or heteroaryl group, S—$R^7$ and $NR^8R^9$;

$R^2$, $R^5$, $R^6$ and $R^7$ are selected from the group consisting of hydrogen, an aliphatic or heteroatomic group, an aryl or heteroaryl group provided that R2 is not —$NR^3R^4$ or —N═$CR^5R^6$;

$R^3$, $R^4$, $R^8$ and $R^9$ are selected from the group consisting of hydrogen, an aliphatic or heteroatomic group; an aryl or heteroaryl group, an acyl group, a sulphonyl group and a phosphoryl group;

wherein any of $R^3$ and $R^4$, $R^5$ and $R^6$, $R^8$ and $R^9$ may represent atoms necessary to form a five to eight membered, and wherein $R^1$ and Y may form a five to eight membered ring, further characterized in that at least one of Y and $R^1$ is substituted by a solubilizing group having a $pK_a$ of 10 or less.

2. A silver halide material according to claim 1, wherein in said compound according to general formula (I), X— is represented by a group according to formula (II), (II)

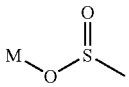

wherein M represents a hydrogen atom or a counterion.

3. A silver halide material according to claim 1, wherein in said compound according to general formula (I), X— is represented by a group according to formula (III), (III)

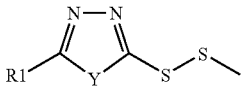

wherein Y and $R^1$ are defined in formula (III) as in claim 1.

4. A silver halide photographic material according to claim 1, wherein said material further comprises a compound according to general formula (IV), (IV)

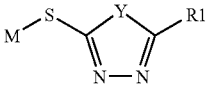

wherein Y and R1 are defined as in claim 1 and M represents a hydrogen atom or a counterion.

5. A silver halide photographic material according to claim 2, wherein said material further comprises a compound according to general formula (IV), (IV)

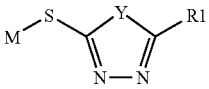

wherein Y and R1 are defined as in claim 1 and M represents a hydrogen atom or a counterion.

6. A silver halide photographic material according to claim 3, wherein said material further comprises a compound according to general formula (IV), (IV)

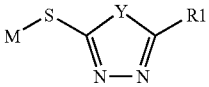

wherein Y and R1 are defined as in claim 1 and M represents a hydrogen atom or a counterion.

7. A silver halide photographic material according to claim 1, wherein said solubilizing group is selected from the group consisting of a carboxylic acid or salt thereof, a sulfonic acid or salt thereof, a phosphonate, a phosphate, a sulfate and an acylsulfonamide or salt thereof.

8. A silver halide photographic material according to claim 2, wherein said solubilizing group is selected from the group consisting of a carboxylic acid or salt thereof, a sulfonic acid or salt thereof, a phosphonate, a phosphate, a sulfate and an acylsulfonamide or salt thereof.

9. A silver halide photographic material according to claim 3, wherein said solubilizing group is selected from the group consisting of a carboxylic acid or salt thereof, a sulfonic acid or salt thereof, a phosphonate, a phosphate, a sulfate and an acylsulfonamide or salt thereof.

10. A silver halide photographic material according to claim 4, wherein said solubilizing group is selected from the group consisting of a carboxylic acid or salt thereof, a sulfonic acid or salt thereof, a phosphonate, a phosphate, a sulfate and an acylsulfonamide or salt thereof.

11. A silver halide photographic material according to claim 5, wherein said solubilizing group is selected from the group consisting of a carboxylic acid or salt thereof, a sulfonic acid or salt thereof, a phosphonate, a phosphate, a sulfate and an acylsulfonamide or salt thereof.

12. A silver halide photographic material according to claim 6, wherein said solubilizing group is selected from the group consisting of a carboxylic acid or salt thereof, a sulfonic acid or salt thereof, a phosphonate, a phosphate, a sulfate and an acylsulfonamide or salt thereof.

13. A silver halide photographic material according to claim 1, wherein Y is a sulfur atom.

14. A silver halide photographic material according to claim 2, wherein Y is a sulfur atom.

15. A silver halide photographic material according to claim 3, wherein Y is a sulfur atom.

16. A silver halide photographic material according to claim 4, wherein Y is a sulfur atom.

17. A silver halide photographic material according to claim 5, wherein Y is a sulfur atom.

18. A silver halide photographic material according to claim 6, wherein Y is a sulfur atom.

19. A silver halide photographic material according to claim 1, wherein $R^1$— is represented by formula (V), wherein (V)

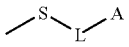

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

20. A silver halide photographic material according to claim 2, wherein $R^1$— is represented by formula (V) wherein (V)

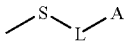

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

21. A silver halide photographic material according to claim 3, wherein $R^1$— is represented by formula (V), wherein (V)

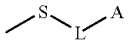

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

22. A silver halide photographic material according to claim 4, wherein $R^1$— is represented by formula (V), wherein (V)

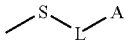

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

23. A silver halide photographic material according to claim 5, wherein $R^1$— is represented by formula (V), wherein (V)

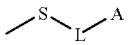

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

24. A silver halide photographic material according to claim 6, wherein $R^1$— is represented by formula (V), wherein (V)

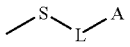

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

25. A silver halide photographic material according to claim 13, wherein $R^1$— is represented by formula (V), wherein (V)

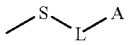

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

26. A silver halide photographic material according to claim 14, wherein $R^1$— is represented by formula (V), wherein (V)

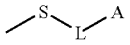

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

27. A silver halide photographic material according to claim 15, wherein $R^1$— is represented by formula (V), wherein (V)

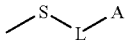

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

28. A silver halide photographic material according to claim 16, wherein $R^1$— is represented by formula (V), wherein (V)

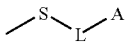

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

29. A silver halide photographic material according to claim 17, wherein $R^1$— is represented by formula (V), wherein (V)

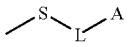

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

30. A silver halide photographic material according to claim 18, wherein $R^1$— is represented by formula (V), wherein (V)

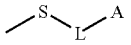

wherein:

A is a solubilizing group selected from the group consisting of a carboxylic acid, a sulfonic acid, a phosphonate, a phosphate, a sulfate and an acylsulfonamide or a corresponding salt thereof, and L represents an aliphatic divalent linking group.

31. A black-and-white silver halide negative working photographic material comprising a subbed transparent support, and, in order, at one or both sides thereof, at least one light-sensitive silver halide emulsion layer, and a protective layer, wherein said material is spectrally sensitized in the wavelength range from 540–570 nm, wherein at least one light-sensitive emulsion layer thereof comprises tabular grains having a thickness in the range from 0.04 μm up to 0.20 μm, wherein said grains having an aspect ratio in the range from 5:1 up to 50:1 represent a projective surface area of at least 70% of the total projected surface of all grains present in the emulsion and wherein said material comprises at least one compound selected from:

II-1

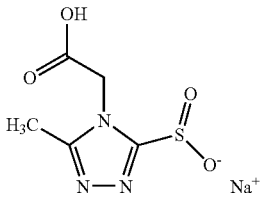

II-2

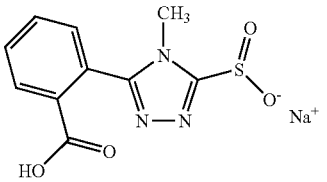

II-3

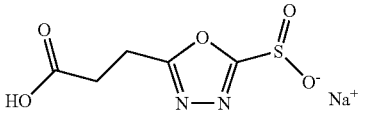

II-4

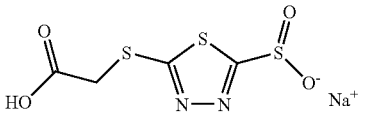

-continued

II-5

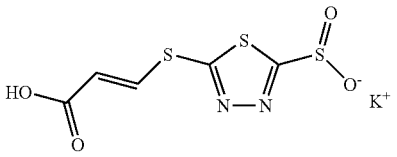

II-6

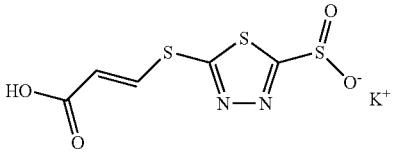

II-7

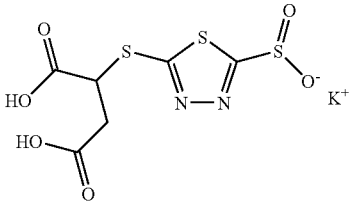

II-8

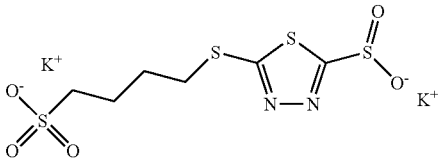

II-10

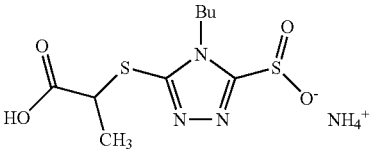

II-13

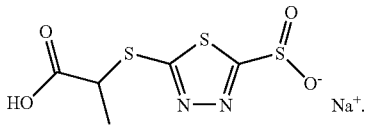

32. A black-and-white silver halide negative working photographic material comprising a subbed transparent support, and, in order, at one or both sides thereof, at least one light-sensitive silver halide emulsion layer, and a protective layer, wherein said material is spectrally sensitized in the wavelength range from 540–570 nm, wherein at least one light-sensitive emulsion layer thereof comprises tabular grains having a thickness in the range from 0.04 μm up to 0.20 μm, wherein said grains having an aspect ratio in the range from 5:1 up to 50:1 represent a projective surface area of at least 70% of the total projected surface of all grains present in the emulsion and wherein said material comprises at least one compound selected from:

(III-1)
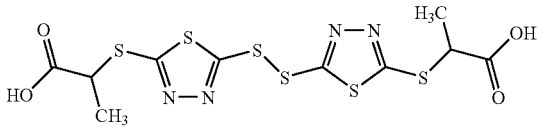
(III-2)
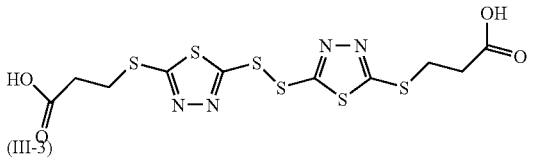
(III-3)
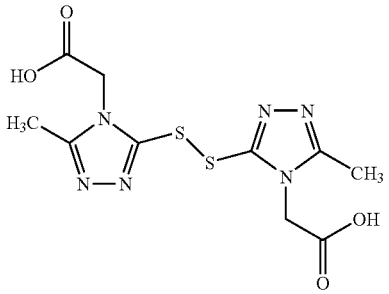
(III-4)
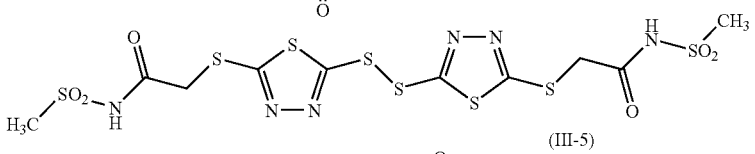
(III-5)
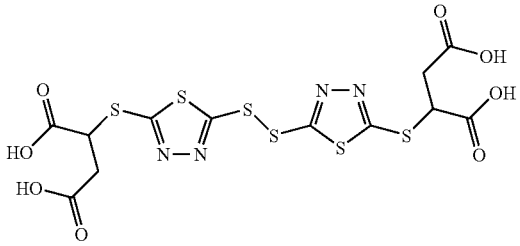
(III-6)
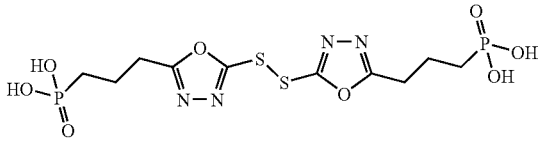
(III-7)
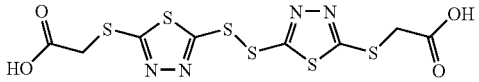
(III-8)
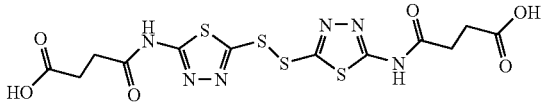
(III-9)
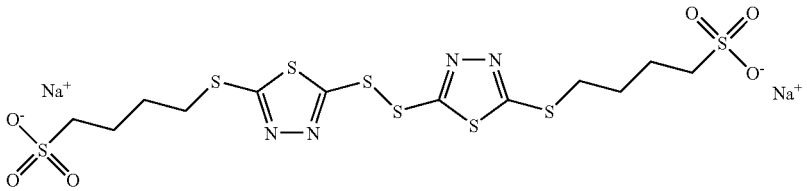

33. A silver halide photographic material according to claim 1, wherein at least one of the compounds according to formula (I) is present in the light-sensitive silver halide emulsion layer or in a layer adjacent thereto, in an amount from $10^{-6}$ to $10^{-1}$ mol per mol of silver halide.

34. A silver halide photographic material according to claim 2, wherein at least one of the compounds according to formula (II) is present in the light-sensitive silver halide emulsion layer or in a layer adjacent thereto, in an amount from $10^{-6}$ to $10^{-1}$ mol per mol of silver halide.

35. A silver halide photographic material according to claim 3, wherein at least one of the compounds according to formula (III) is present in the light-sensitive silver halide emulsion layer or in a layer adjacent thereto, in an amount from $10^{-6}$ to $10^{-1}$ mol per mol of silver halide.

36. A silver halide photographic material according to claim 1, wherein at least one of the compounds according to the formula (I) is present in the light-sensitive silver halide emulsion layer or in a layer adjacent thereto, in an amount from 0.4 mmol to 0.1 mol per mol of silver halide.

37. A silver halide photographic material according to claim 2, wherein at least one of the compounds according to the formula (II) is present in the light-sensitive silver halide emulsion layer or in a layer adjacent thereto, in an amount from 0.4 mmol to 0.1 mol per mol of silver halide.

38. A silver halide photographic material according to claim 3, wherein at least one of the compounds according to the formula (III) is present in the light-sensitive silver halide emulsion layer or in a layer adjacent thereto, in an amount from 0.4 mmol to 0.1 mol per mol of silver halide.

39. A silver halide photographic material according to claim 1, wherein the coating amount of the tabular silver halide grains, expressed as an equivalent amount of silver nitrate, is in a range of from 0.1 to 6 $g/m^2$.

40. A silver halide photographic material according to claim 2, wherein the coating amount of the tabular silver halide grains, expressed as an equivalent amount of silver nitrate, is in a range of from 0.1 to 6 $g/m^2$.

41. A silver halide photographic material according to claim 3, wherein the coating amount of the tabular silver halide grains, expressed as an equivalent amount of silver nitrate, is in a range of from 0.1 to 6 $g/m^2$.

42. A silver halide photographic material according to claim 1, wherein inbetween said light-sensitive silver halide emulsion layer and said protective layer, an intermediate non-light sensitive hydrophilic layer is present, coated with fine silver halide grains rich in silver iodide.

43. A silver halide photographic material according to claim 2, wherein inbetween said light-sensitive silver halide emulsion layer and said protective layer, an intermediate non-light sensitive hydrophilic layer is present, coated with fine silver halide grains rich in silver iodide.

44. A silver halide photographic material according to claim 3, wherein inbetween said light-sensitive silver halide emulsion layer and said protective layer, an intermediate non-light sensitive hydrophilic layer is present, coated with fine silver halide grains rich in silver iodide.

45. A silver halide photographic material according to claim 4, wherein inbetween said light-sensitive silver halide emulsion layer and said protective layer, an intermediate non-light sensitive hydrophilic layer is present, coated with fine silver halide grains rich in silver iodide.

46. A silver halide photographic material according to claim 1, wherein inbetween said light-sensitive silver halide emulsion layer and said subbed transparent support, an intermediate non-light sensitive hydrophilic layer is present, coated with fine silver halide grains rich in silver iodide.

47. A silver halide photographic material according to claim 2, wherein inbetween said light-sensitive silver halide emulsion layer and said subbed transparent support, an intermediate non-light sensitive hydrophilic layer is present, coated with fine silver halide grains rich in silver iodide.

48. A silver halide photographic material according to claim 3, wherein inbetween said light-sensitive silver halide emulsion layer and said subbed transparent support, an intermediate non-light sensitive hydrophilic layer is present, coated with fine silver halide grains rich in silver iodide.

49. A silver halide photographic material according to claim 4, wherein inbetween said light-sensitive silver halide emulsion layer and said subbed transparent support, an intermediate non-light sensitive hydrophilic layer is present, coated with fine silver halide grains rich in silver iodide.

50. A silver halide photographic material according to claim 1, wherein in said protective layer fine silver halide grains rich in silver iodide are present.

51. A silver halide photographic material according to claim 2, wherein in said protective layer fine silver halide grains rich in silver iodide are present.

52. A silver halide photographic material according to claim 3, wherein in said protective layer fine silver halide grains rich in silver iodide are present.

53. A silver halide photographic material according to claim 4, wherein in said protective layer fine silver halide grains rich in silver iodide are present.

54. A silver halide photographic material according to claim 42, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

55. A silver halide photographic material according to claim 43, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

56. A silver halide photographic material according to claim 44, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

57. A silver halide photographic material according to claim 45, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

58. A silver halide photographic material according to claim 46, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

59. A silver halide photographic material according to claim 47, wherein said fine grains rich in silver iodide having a grain diameter of not more than 100 nm, are coated in amounts in the range from 0.3 to 0.6 $g/m^2$, wherein said amounts are expressed as equivalent amounts of silver nitrate.

60. A silver halide photographic material according to claim 48, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

61. A silver halide photographic material according to claim 49, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

62. A silver halide photographic material according to claim 50, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

63. A silver halide photographic material according to claim 51, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

64. A silver halide photographic material according to claim 52, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

65. A silver halide photographic material according to claim 53, wherein said fine grains rich in silver iodide having a grain diameter of not more than 100 nm, are coated in amounts in the range from 0.3 to 0.6 g/m$^2$, wherein said amounts are expressed as equivalent amounts of silver nitrate.

66. A silver halide photographic material according to claim 1, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

67. A silver halide photographic material according to claim 2, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

68. A silver halide photographic material according to claim 3, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

69. A silver halide photographic material according to claim 4, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

70. A silver halide photographic material according to claim 46, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

71. A silver halide photographic material according to claim 47, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

72. A silver halide photographic material according to claim 48, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

73. A silver halide photographic material according to claim 49, wherein said material is a single-side or double side coated radiographic material, wherein average thicknesses of the tabular grains present in a light-sensitive layer thereof are in the range from 0.06 to 0.15 μm and wherein average aspect ratios of said tabular grains are in the range from 10:1 to 25:1.

74. A black-and-white silver halide negative working photographic material comprising a subbed transparent support, and, in order, at one or both sides thereof, at least one light-sensitive silver halide emulsion layer, and a protective layer, wherein said material is spectrally sensitized in the wavelength range from 540–570 nm, wherein at least one light-sensitive emulsion layer thereof comprises tabular grains having a thickness in the range from 0.04 μm up to 0.20 μm, wherein said grains having an aspect ratio in the range from 5:1 up to 50:1 represent a projective surface area of at least 70% of the total projected surface of all grains present in the emulsion and wherein said material comprises at least one compound according to general formula (I): (I)

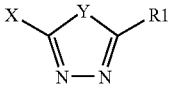

wherein:

X represents a functional group containing sulfur, apart from a thiol group or a thiolate;

Y is selected from the group consisting of an oxygen atom, a sulfur atom, $NR^2$, $R^1$ is selected from the group consisting of hydrogen, a heteroatomic group, an aryl or heteroaryl group, S—$R^7$ and $NR^8R^9$;

$R^2$ is selected from the group consisting of hydrogen, an aliphatic and an aryl group;

$R^5$, $R^6$ and $R^7$ are selected from the group consisting of hydrogen, an aliphatic or heteroatomic group, an aryl or heteroaryl group;

$R^3$, $R^4$, $R^8$ and $R^9$ are selected from the group consisting of hydrogen, an aliphatic or heteroatomic group; an aryl or heteroaryl group, an acyl group, a sulphonyl group and a phosphoryl group;

wherein any of $R^3$ and $R^4$, $R^5$ and $R^6$, $R^8$ and $R^9$ may represent atoms necessary to form a five to eight membered, and wherein $R^1$ and Y may form a five to eight membered ring, further characterized in that at least one of Y and $R^1$ is substituted by a solubilizing group having a $pK_a$ of 10 or less.

* * * * *

UNITED STATES PATENT AND TRADEMARK OFFICE

CERTIFICATE OF CORRECTION

PATENT NO. : 7,129,031 B2
APPLICATION NO. : 10/872182
DATED : June 18, 2004
INVENTOR(S) : Loccufier et al.

It is certified that error appears in the above-identified patent and that said Letters Patent is hereby corrected as shown below:

Please add between item (22) and item (65) on the face the following:

Related U.S. Application Data

(60) Provisional application No. 60/483,835 filed June 30, 2003

Signed and Sealed this

Twenty-seventh Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,129,031 B2
APPLICATION NO. : 10/872182
DATED : October 31, 2006
INVENTOR(S) : Loccufier et al.

It is certified that error appears in the above-identified patent and that said Letters Patent is hereby corrected as shown below:

Please add between item (22) and item (65) on the face the following:

Related U.S. Application Data

(60) Provisional application No. 60/483,835 filed June 30, 2003

This certificate supersedes Certificate of Correction issued March 27, 2007.

Signed and Sealed this

Seventeenth Day of April, 2007

JON W. DUDAS
*Director of the United States Patent and Trademark Office*